United States Patent [19]

Steinmetz et al.

[11] 4,025,059

[45] May 24, 1977

[54] DEVICE FOR THE CONTINUOUS PRODUCTION OF STEEL

[75] Inventors: Eberhard Steinmetz; Jürgen Kuhn, both of Bochum, Germany

[73] Assignee: Fried. Krupp Huttenwerke AG, Bochum, Germany

[22] Filed: Apr. 8, 1975

[21] Appl. No.: 566,642

[30] Foreign Application Priority Data

Apr. 13, 1974 Germany ..... 2418109

[52] U.S. Cl. ..... 266/215

[51] Int. Cl.[2] ..... C21C 7/00

[58] Field of Search ..... 266/9, 11, 34 R, 35, 266/207, 212, 215–217, 237; 75/59, 60

[56] References Cited

UNITED STATES PATENTS

| | | | |
|---|---|---|---|
| 465,672 | 12/1891 | Lindenthal | 75/60 |
| 714,451 | 11/1902 | Carson | 266/35 |
| 2,034,071 | 3/1936 | Wickland | 266/11 |
| 3,865,579 | 2/1975 | Williams | 75/60 |

FOREIGN PATENTS OR APPLICATIONS

| | | | |
|---|---|---|---|
| 74,329 | 11/1960 | France | 266/212 |

OTHER PUBLICATIONS

Journal of the Iron & Steel Institute, Apr. 1954, pp. 430–432.

Klepzig Fachbericht, 79, 1971, pp. 573–574.

*Primary Examiner*—Gerald A. Dost

*Attorney, Agent, or Firm*—Burgess, Dinklage & Sprung

[57] ABSTRACT

An apparatus for the continuous production of steel comprising a generally vertical shaft melting zone having a floor, a generally horizontally running refining zone in fluid communication with a lower region of said vertical shaft, the floor of said refining zone disposed at an inclination with respect to the floor of said shaft, said horizontally running refining zone being in fluid communication with an oxidation zone comprising a well disposed below the level of the floor of said horizontally running refining zone.

20 Claims, 5 Drawing Figures

(A-A)

DEVICE FOR THE CONTINUOUS PRODUCTION OF STEEL

BACKGROUND OF THE INVENTION

1. Field of the Invention

This invention relates to an apparatus for the continuous production of steel. More particularly, this invention relates to an apparatus for the continuous production of steel whereby the source of iron can be pig iron, scrap iron and/or sponge iron. This invention is particularly concerned with an apparatus for the production of steel comprising a vertical shaft which is in fluid communication with an inclined generally horizontally running refining zone terminating in an oxidation zone into which is introduced blasting gas. The invention has as its object the beneficial use of the oxigen containing gases introduced in an oxidation zone downstream of the horizontally running refining zone. In accordance with the invention there is provided such an apparatus for the continuous production of steel from various sources of iron wherein in a generally horizontally running refining zone, the melt runs countercurrent to the flow of gases thereabove and countercurrent to the flow of slag thereabove.

2. Discussion of the Prior Art

Devices and processes for the continuous production of steel are known. One such device is disclosed in the *Journal of the Iron and Steel Institute*, April 1954, pages 430–432. In such article there is disclosed an apparatus for the improvement of the thermal efficiency in which hot gases are caused to move in countercurrent flow against the scrap iron being melted down. In one embodiment, the scrap iron is fed vertically from above at one end of the plant as the hot gas flows in the opposite direction. The scrap iron is melted off on an inclined plane and then passed away horizontally in counterflow with the melt. Liquid metal can be fed to this refining process via the inclined plane.

In a second embodiment, the scrap iron is introduced by means of pushing members via the inclined plane. In practice, the concept of preheating the waste iron was effected in the countercurrent flow while continuously charging an inclined plane having three stages. At the end of the inclined plane there was disposed a Siemens-Matin furnace (*Steel Times*, 1964, page 398–401 and *Iron and Coal*, 1961, pages 1243–1245). It was found that such an arrangement could not be employed for the continuous production of steel with counterflow of steel and slag.

Numerous proposals and experiments have been provided for the continuous production of steel. However, the proposals heretofore made have relied upon the use of pig iron as the iron source (see *Klepzig Fachbericht*, 79, 1971, pages 570, 575). Thus in Klepzig picture 10 on page 574, there is shown a device comprising an electromagnetic countercurrent flow channel and a converter. This device only enables the use of liquid pig iron as the raw material. In contrast, the continuous steel production proposed in picture 8 of page 573 thereof allows the use of pig iron, scrap iron or sponge iron as raw materials. For this purpose, in front of the countercurrent flow channel there is arranged an electric arc furnace to which the raw material is continuously supplied.

It has become desirable, however, to provide an apparatus which does not require the use of an electric arc furnace and can continuously produce steel from pig iron, scrap iron or sponge iron which can be fed to the apparatus in solid form. It has become particularly desirable to provide a device of such nature to which liquid pig iron can be fed directly and employed in combination with another source of iron to form the steel.

SUMMARY OF THE INVENTION

The objects of this invention are provided by an apparatus for the continuous production of steel, which apparatus comprises a generally vertial shaft melting zone having a floor, a generally horizontally running refining zone in fluid communication with a lower region of said shaft, the floor of said refining zone disposed at an incline with respect to the floor of said vertical shaft, said horizontally running refining zone being in fluid communication with an oxidation zone comprising a well disposed below the level of the floor of said horizontally running refining zone.

In accordance with this invention, there is provided an apparatus which essentially comprises three distinct zones. Initially, there is a melting zone in which the source of iron is melted. This melting zone is in the form of a vertical shaft and generally contains means for feeding solid scrap iron, sponge iron or pig iron thereto and means for permitting the escape of hot gases to be described below. The apparatus is in fluid communication at the bottom thereof with a generally horizontally running refining zone, the floor of which is generally inclined with respect to the floor of the vertical shaft. The ceiling of such horizontal zone, however, need not be inclined, and it runs generally horizontal. This horizontally running refining zone is in fluid communication with the lower regions of the vertical shaft. Molten metal is moved up the incline by virtue of the fact that the floor of the horizontal zone is in the form of an electromagnetic countercurrent flow channel generally having in cross section a plane floor, but may have too a trough-like configuration.

The horizontally running zone is in fluid communication with a third zone, denominated as an oxidation zone. Into this zone passes the molten metal which descends from the floor of the horizontal zone into a well. Into the well there is injected a blasting gas such as an oxygen-containing gas such that the gas passes through much of the metal contained in the well. Preferably the oxigen-containing gas is blasted onto the surface of said molten metal contained in said well.

In the process any slag that forms passes in the horizontal refining zone in fluid communication therewith on top of the molten metal. Downstream of the oxidation zone and at a point proximate the entrance to the horizontally running refining zone is a slag outlet.

The device of this invention offers the advantage that optimum exploitation of the gases results from the oxidation process. Mixed charges of raw material can be employed having a wide composition range. These can be melted down into a melting aggregate and simultaneously metallurgically treated.

The countercurrent channel of the horizontally running refining zone, in a first embodiment, has an inclination of 4° to 10°, preferably 6° to 9°. In a second embodiment, the countercurrent flow channel has a steeper inclination at the point where it is integral with the floor of the vertical shaft. Here, the floor of the countercurrent flow channel forms an inclination wit the floor of the vertical shaft of over 10° and up to 23°, preferably 15° to 19°. It is preferred that the floor of the vertical shaft furnace has a trough - like depression in the direction of the end furthest from the opening. The above-mentioned arrangement for the opening end of the channel in combination with the floor of the vertical shaft serves to provide a melting tank in which scrap metal can be dissolved under desired conditions.

In a further and preferred embodiment of the invention, an inlet for the introduction of melted iron alloys is employed. This inlet is in fluid communication with a lower portion of the vertical shaft furnace. The vertical shaft can have a wall running vertically to form a vertically disposed weir in facing relationship with the floor of the vertical shaft itself, whereby to define a fluid entrance. The floor of the vertical shaft is connected exteriorly of the wall of the vertical shaft to a vertical riser which, exteriorly of the wall of the vertical shaft, overlies the wall to define a reservoir zone. The reservoir zone is thus in fluid communication with the interior of the vertical shaft via the fluid entrance defined between the wall of the vertical shaft and the floor thereof. This permits the introduction of melted iron alloys directly into the shaft furnace in the region of the melting tank. Preferably, the reservoir and opening are provided opposite the opening end of the countercurrent flow channel in the horizontally running refining zone. This embodiment has the advantage that the liquid pig iron flows along the preheated scrap and thus dissolves the scrap.

In yet a further embodiment, the shaft furnace is provided with blasting devices for components which reduce and/or lower the melting point, whereby the blasting devices are arranged in the lower region of the vertical shaft furnace, especially in the region of the melting tank. The advantage of employing blasting devices is that reducing substances which lower the melting point and preferably react exothermically, such as silicon and phosphorous and carbon, can be injected directly into the melt in the shaft furnace or just above the liquid melt. One advantage of this embodiment is that intensive melting of the iron source at lower temperatures is provided by which the lining of the shaft is preserved.

In a still further embodiment, the shaft furnace has blasting devices for oxidizing gases midway up the shaft. Through these blasting devices, oxygen can be blown through to burn the waste gases.

In this manner, gases which enter in the oxidation zone are caused to pass over the slag in the refining zone and in countercurrent to the flow of the metal and thus, to rise upwardly in the vertical shaft whereby to heat the descending scrap iron and the like. Gases introduced into the vertical furnace can serve to complete the combustion of waste gases rising through the vertical shaft.

In another embodiment of the invention, at the lower end of the shaft there are provided heating devices, especially heating devices operated by electrical energy. Here, laterally arranged devices are especially recommended as are known in special electroshaft furnaces.

Generally speaking, there are two different modes for carrying out the invention. In one mode, the refining zone is integral with the vertical shaft furnace. In another mode, the shaft furnace may be arranged next to the first half of the horizontally running refining zone and there is provided an intermediate zone having a partial circuit. When an intermediate zone is employed the floor of the shaft furnace is connected via a first channel to the lowest part (metal entry) of said horizontally running refining zone and a second channel is provided between the first half of said horizontally running refining zone and a part of said shaft furnace above the melting tank so that a partial circuit of the metal from the floor of the melting tank via the first channel via the lower half of the refining zone then via the second channel and back to the melting tank is possible. Preferbly said second channel an electromagnetic channel.

In either embodiment, i.e., where the shaft furnace is arranged next to the horizontally running refining zone or next to the first half therefrom, the horizontally running refining zone is preferably provided with an electromagnetic channel as a conduit. Generally, the electromagnetic channel has a floor plane in cross section.

Preferably, the refining zone is provided with blasting devices directed at the region of the slag-metal boundary layer or interface as disclosed in German Pat. Nos. 2,107,263 and U.S. 3,861,905. In such an instance, it is expendient for the floor of the refining zone to have a trough-like construction. In any event, it is desired that the third or oxidation zone be provided with a floor depth well beneath the floor level of the horizontal zone whereby to act as a well in receiving the molten metal from the refining zone. Into this zone there is injected a stream of oxygen which does not quite reach the floor thereof. This is reached at a floor depth of 50 to 90 cm, especially 70 cm, depending on the construction of the oxygen lance.

According to a preferred process, raw materials are oxidisingly melted down toward the lower region of the vertical shaft furnace, and the resultant iron oxide-containing slag is conveyed via said second channel to the horizontally disposed refining zone countercurrent to the partial metal circuit. The metal melt containing reducing agents is removed from the melting tank via the first channel, via the refining zone, and a part of the metal melt is conveyed back to the melting tank from half way up of the refining zone via said second channel in an opposite direction to said iron oxide containing slag. This partial circulation better exploits the raw materials which are melted down in the shaft furnace. This latter described embodiment is particularly favorable for accumulating a drop in oxygen potential on the counter-current flow channel as discussed in German Auslegeschrift No. 1,956,297 and in British Pat. No. 1,334,372.

In accordance with the invention, the following advantages are obtained:

1. A simple melting down of aggregates from various sources of raw materials, especially scrap iron, is provided which consumes a minimum of energy. The consumption of energy is decreased even more by the effective use of the waste gases. The special arrangement of the vertical shaft furnace and the horizontally disposed refining zone provides for fast scrap dissolution.

2. The addition of reducing substances lowering the melting point of the raw materials improves the heat budget of the system considerably. An addition of coke or the injection of other solid, liquid or gaseous fuels into the shaft furnace can be omitted, depending upon the raw material, if substances lowering the melting point of the iron source are injected into the melt. This measure is preferably supplemented by selecting those materials which have a strong exothermic reaction and by continuously injecting the same with the use of oxygen. Carbon, silicon, ferrosilicon and ferrophosphorous are examples of such desired materials.

3. The entire process works on the basis of a countercurrent flow, thereby providing an intensive utilization of material and energy.

4. The reaction are beneficially conducted on a countercurrent flow channel through the use of a potential drop construction.

The apparatus can be used in any number of configurations to utilize raw material of 100% pig iron or 100% scrap iron. The apparatus is equally suitable for combined charges of solid raw material and liquid pig iron. The quantity of liquid pig iron is preferably 20 to 80%, based upon the total quantity of raw material employed. Quantities of 40 to 60% pig iron are particularly preferred.

BRIEF DESCRIPTION OF DRAWINGS

In order to more fully appreciate the nature of the invention, reference is made to the accompanying drawings in which.

DESCRIPTION OF SPECIFIC EMBODIMENTS

Figure 1:
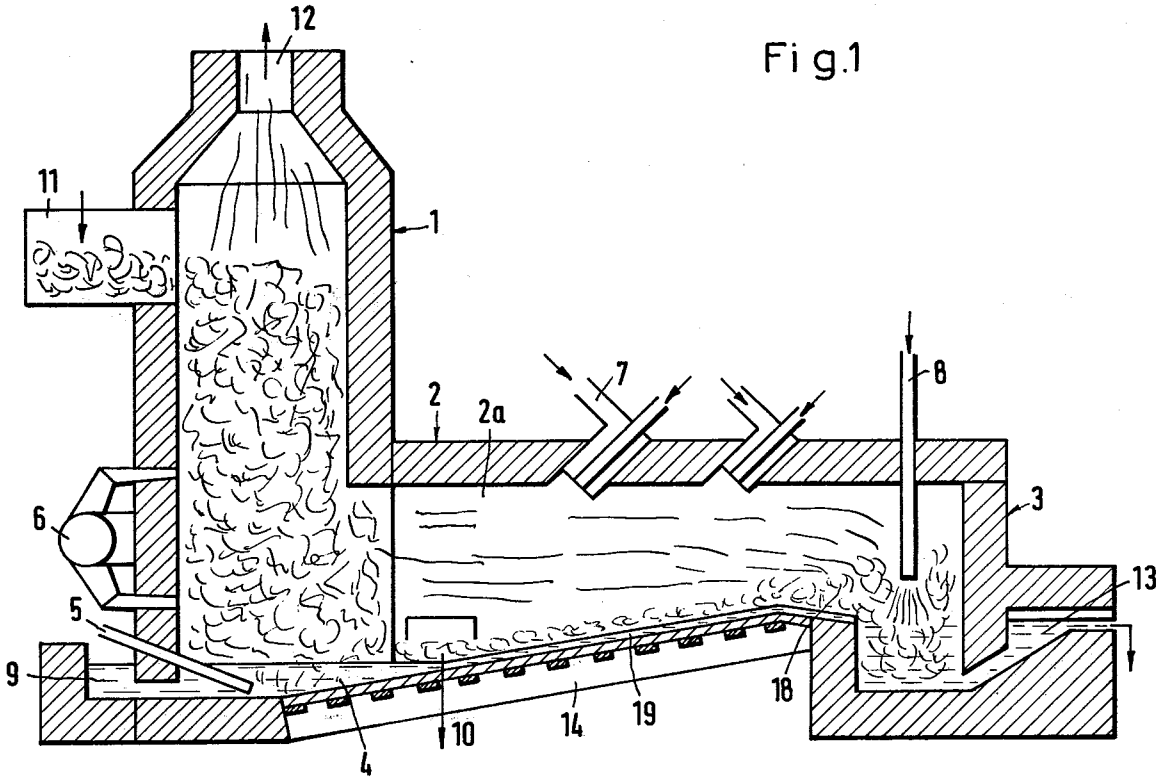
FIG. 1 is a longitudinal sectional view through an embodiment of the apparatus of this invention.

Referring to FIG. 1 there is shown an apparatus according to the invention comprising a vertically disposed shaft furnace 1 which is integral with a second chamber which functions as a horizontally running refining zone, which chamber terminates in a third chamber or zone in the form of a well 3 which functions as an oxidation zone. The second chamber section 2 of the horizontally running refining zone has a waste gas channel 2*a* for removal of gases which enter the apparatus through conduit 8. The floor of the chamber 2 is in the form of an electromagnetic countercurrent flow channel 14 which serves to move molten metal thereabove from the melting tank 4 of the vertical shaft furnace 1 to the well beneath the conduit 8. The slag 18 resulting from the refining process is conveyed in the opposite direction to the metal melt 19 derived from the melting tank 4. Into the melting tank 4 there are disposed blasting lances 5, only one of which is shown in FIG. 1. Alternatively, nozzles can be positioned in the region of the tank. Further blasting devices 6 are disposed above the melting tank 4. Substances lowering the melting point of the components of the melting tank, such as carbon or carbon carriers, can be blasted in through these blasting lances 5 and 6 into the lower end of the vertical shaft 1. This has an advantageous effect on the overall melting process and, because it reduces the melting point, it preserves the durability of the fireproof lining of the melting tank.

Blasting devices 7 and 8 are passed through the upper wall or ceiling of the horizontal oxidizing zone. The addition of slag formers and other auxiliary substances is effected through apertures not shown in FIG. 1. Melted iron alloys, especially pig iron, can be added via the inlet 9. Here, the melted pig iron is introduced into a reservoir defined by a wall of the vertical shaft itself and a riser, which reservoir communicates in fluid relationship with the bottom portion of the melting tank as shown in FIG. 1.

The resultant slag which is formed in the process is removed via the slag outlet 10 disposed proximate the inlet to the horizontally running refining zone. Moreover, according to FIG. 1 there is provided a scrap iron sluice 11 and an outlet 12 for removal of waste gases. The ready steel leaves the device via a siphon-like outlet 13. This outlet is positioned downstream of a vertically disposed weir which, together with the floor of the well of the oxidation zone, forms a fluid outlet for removal of the refined steel.

Figures 2, 2A:
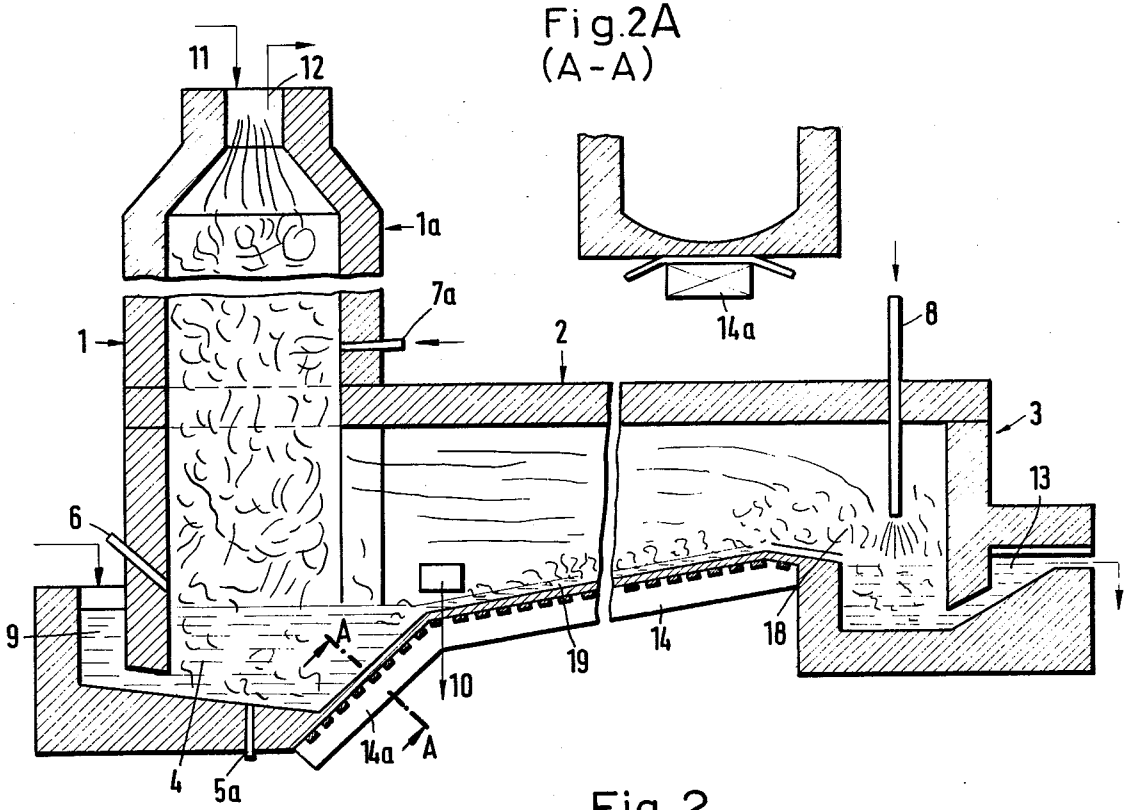
FIG. 2 is a view similar to FIG. 1 showing a longitudinal section through another embodiment of the invention together with a detail of the trough-shaped floor of the sheeper part of the horizontally running refining zone, said detail being in the form of a sectional view taken along the line A-A of FIG. 2.
FIG. 2A is a sectional view taken along the line A-A of FIG. 2.

In FIG. 2 there is shown another embodiment where no separated scrap iron sluice 11 is provided. The addition of scrap iron is effected at the top of the apparatus through the orifice out of which pass the waste gases. According to FIG. 2, the end of the channel 14*a* ends at the deepest point of the melting tank 5 which is also the deepest point opposite the siphon 9 for the introduction of liquid pig iron. In FIG. 2 there is shown an embodiment wherein the floor of the horizontal zone is inclined at the point where it meets the floor of the vertical shaft at a greater angle of inclination than is employed through the major dimension of the horizontal zone. At the deepest point, the melting tank has preferably a height of 60–120 cm. As shown in section A—A, the steep channel end 14*a* has a synclinal cross section when crossing from the first chamber section 1 to the second chamber section 2, the inductor of channel 14*a* being arranged at the lowest point of the cross section. In FIG. 2, blasting nozzles 5*a* are positioned opening into the floor of the melting tank 4. Alternatively, they can open laterally into the side of the melting tank 4. Furthermore, the shaft furnace 1 is provided with blasting devices 7*a* for oxidizing gases midway up the vertical shaft.

As FIG. 2 also show, there is a preheating portion 1*a* of the shaft furnace constructed as a separate section. This preheating portion forms about ½ to ⅔ of the total height of the shaft furnace. The preheating portion 1*a* is placed on the first chamber section having the melting tank 4*a*. The advantage of such a construction is that fireproof masonry of the entire melting portion, i.e., from the melting tank 4 to the third chamber section 3, can be lined as a unit with a fireproof material.

Figure 3:
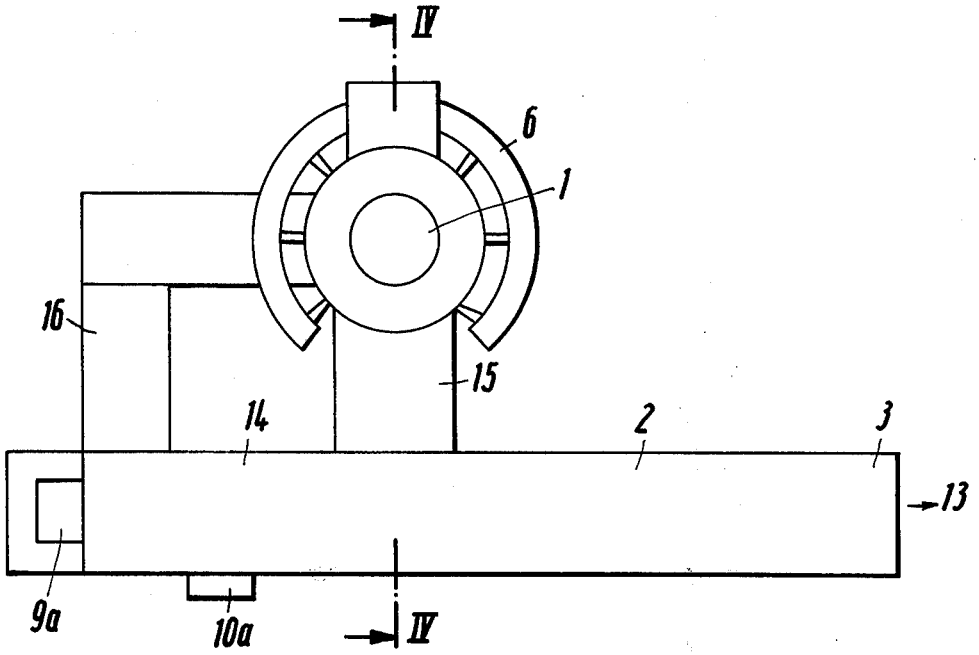
FIG. 3 is a schematic aerial view of a third embodiment of the invention.
Figure 4:
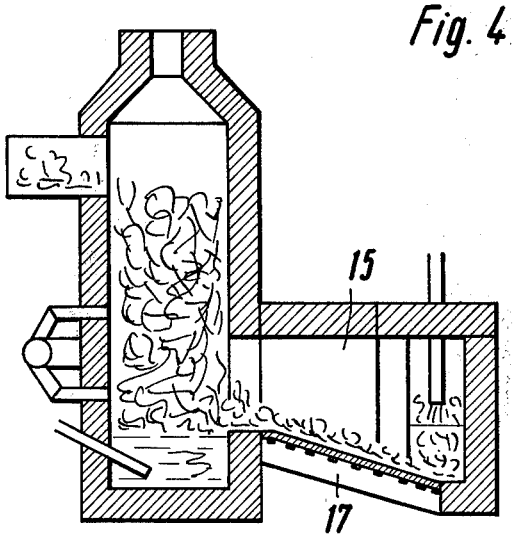
FIG. 4 is a sectional view taken along the line IV—IV of FIG. 3.

In the alternate embodiment of FIGS. 3 and 4, there is shown an arrangement where the horizontal refining zone 2 is disposed remote from the shaft furnace. The shaft furnace 1 is connected thereto via a channel 15 roughly halfway up the length of the second or horizontal chamber section. In the exemplified embodiment of FIG. 4, the channel 15 is provided with an electromagnetic channel 17. The shaft furnace is also connected via a channel 16 with the beginning of the horizontally running oxidation zone or second chamber 2. By this, a partial circuit between the shaft furnace 1 and a part of the second chamber 2 is enabled, and the melt can be conveyed via the first channel 16, the lower portion of channel 14 via second channel 15 back into the melting tank of the shaft furnace.

In the apparatus of the invention, reducing agents which lower the melting point of the raw iron components can be introduced in a partial circuit according to FIGS. 3 and 4 via channel 16. The inlet for liquid alloys, e.g., pig iron, is designated in FIGS. 3 and 4 by 9*a* and the slag outlet by 10*a*.

It is obvious that the apparatus of the present invention enables the use of a variety of raw material charges. In the shaft furnace, scrap iron and/or pig iron is preferably used in combination with solid pig iron or coke. Liquid iron alloys, especially liquid pig iron, can also be fed into the melting tank as described above.

According to the invention, in a preferred embodiment carbon is injected directly into the melting tank and/or is introduced a short distance, e.g., about 20–100 cm, above the melting tank in order to lower the melting point of the raw material charge. In such instaces, it is recommended that the amount of carbon employed be that equal to the value *m* according to the following equation:

$$\frac{m_{carbon}}{m_{scrap\ iron}} = \left(1 - \frac{1}{2} \cdot \frac{m_{pig\ iron}}{m_{scrap\ iron}}\right) \cdot 0.09 \pm 0.02$$

*m* = a quantity of mass in kg, pounds or the like.

By such an apparatus, particularly good conditions for melting of scrap iron and the refining of the same into steel are provided vis-a-vis known plants. According to the apparatus of the invention, higher proportions of scrap iron per unit of time can be employed. The apparatus provides for good dissolution of scrap iron under flow conditions maintained in the apparatus. A further advantage of the device resides in the fact that optimal exploitation of waste gases is attained, thereby providing for an improved economy of process.

What is claimed is:

1. Apparatus for the continuous production of steel comprising a generally vertical shaft melting zone having a floor, means for feeding solid pig iron, scrap iron or sponge iron to an upper region of said vertical shaft melting zone, means for melting said pig iron, scrap iron or sponge iron in said vertical shaft melting zone, a generally horizontally running refining zone in fluid communication with a lower region of said shaft, a portion of the wall of said vertical shaft forming a generally vertically disposed weir in facing relationship with the floor of said shaft to define a fluid entrance, said floor having connected thereto exteriorly of said wall of said vertical shaft a vertical riser overlapping a portion of said wall to define a reservoir zone, said reservoir zone being in fluid communication via said fluid entrance with the interior of said vertical shaft, the floor of said refining zone disposed upwardly at an inclination with respect to the floor of said shaft and being in the form of an electromagnetic countercurrent flow channel, said horizontally running refining zone being in fluid communication with an oxidation zone comprising a well disposed below the level of the floor of said refining zone.

2. Apparatus according to claim 1 wherein said oxidation zone includes a vertically disposed weir in said well defining with the wall of said well a fluid exit therebeneath.

3. Apparatus according to claim 2 wherein said oxidation zone includes blasting means for directing a stream of an oxygen-containing gas into the contents of said well.

4. Apparatus according to claim 1 further comprising means for directing gas in said horizontally running refining zone up through vertical shaft.

5. Apparatus according to claim 4 wherein said vertical shaft includes means for feeding pig iron, scrap iron or sponge iron therein and means for withdrawing hot gases therefrom.

6. Apparatus according to claim 5 wherein said vertical shaft comprises at least one injection inlet for injection of exotheric agent or melting point reducing agent.

7. Apparatus according to claim 5 wherein said horizontal zone includes at least one gas injector disposed in the walls thereof above the floor thereof angularly directed toward said vertical shaft.

8. Apparatus according to claim 1 wherein the floor of said oxidation zone has a trough-shaped configuration.

9. Apparatus according to claim 1 wherein said floor of said horizontally running refining zone has an inclination of 4° to 10°.

10. Apparatus according to claim 9 wherein at the point the floor of said horizontally running refining zone meets the floor of said vertical shaft, said floor of said horizontally running refining zone has an inclination to 10° to 23°.

11. Apparatus according to claim 10 wherein the inclination of the floor of the horizontally running refining zone at the point that it meets the floor of said vertical shaft is between 15° and 19°.

12. Apparatus according to claim 9 wherein said floor of said horizontally running refining zone has an inclination of 6° to 9°.

13. Apparatus according to claim 9 wherein said horizontally running refining zone includes a slag outlet proximate the point where said zone communications with said vertical shaft.

14. Apparatus according to claim 1 wherein the floor of said horizontally running refining zone is integral with the floor of said vertical shaft.

15. Apparatus according to claim 1 wherein said horizontally running refining zone is connected in fluid communication to said vertical shaft via an intermediate zone declining from said vertical shaft to said horizontally running refining zone.

16. Apparatus according to claim 15 wherein said horizontally running refining zone is inclined with respect to said intermediate zone.

17. Apparatus for the continuous production of steel comprising a generally vertical shaft melting zone having a floor, means for feeding solid pig iron, scrap iron or sponge iron to an upper region of said vertical shaft melting zone, means for melting said pig iron, scrap iron or sponge iron in said vertical shaft melting zone, a generally horizontally running refining zone in fluid communication with the lower region of said shaft, the floor of said refining zone disposed unwardly at an inclination with respect to the floor of said shaft and being in the form of an electromagnetic countercurrent flow channel, said horizontally running refining zone being in fluid communication with an oxidation zone comprising a well disposed below the level of of the floor of said refining zone.

18. An apparatus according to claim 17 wherein said floor of said horizontally running refining zone has an inclination of 4° to 10°.

19. An apparatus according to claim 17 wherein the floor of said horizontally running refining zone is integral with the floor of said vertical shaft.

20. Apparatus for the continuous production of steel comprising a generally vertical shaft melting zone having a floor, a generally horizontally running refining zone in fluid communication with the lower region of said shaft, the floor of said refining zone disposed at an inclination with respect to the floor of said shaft, said horizontally running refining zone being in fluid communication with an oxidation zone comprising a well disposed below the level of the floor of said refining zone, said horizontally running refining zone being connected in fluid communication with said vertical shaft through a plurality of intermediate zones, each of which intermediate zones is connected to said vertical shaft at a different point thereof and to said horizontally running refining zone.

* * * * *

UNITED STATES PATENT AND TRADEMARK OFFICE

CERTIFICATE OF CORRECTION

PATENT NO. : 4,025,059

DATED : May 24, 1977

INVENTOR(S) : Eberhard Steinmetz et al

It is certified that error appears in the above-identified patent and that said Letters Patent are hereby corrected as shown below:

Column 1, line 46, "Siemens-Matin" should read -- Siemens-Martin --.

Column 2, line 11, "vertial" should read -- vertical --.

Column 8, line 10 (claim 6, line 3), "exotheric" should read -- exothermic --.

Column 8, line 25 (claim 10, line 5), "to" (first occurrence) should read -- of --.

Column 8, line 35 (claim 13, line 3), "communications" should read -- communicates --.

Column 8, line 56 (claim 17, line 9), "unwardly" should read -- upwardly --.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*